US006344707B1

(12) United States Patent
Kibbey

(10) Patent No.: US 6,344,707 B1
(45) **Date of Patent: *Feb. 5, 2002**

(54) SPARK PLUG

(75) Inventor: Wilbur R. Kibbey, Tampa, FL (US)

(73) Assignee: Flashpoint, Inc., Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/435,725

(22) Filed: Nov. 8, 1999

Related U.S. Application Data

(62) Division of application No. 08/774,233, filed on Dec. 27, 1996, now Pat. No. 5,982,079.

(60) Provisional application No. 60/009,407, filed on Dec. 29, 1995.

(51) Int. Cl.[7] ..... H01T 13/20; H01T 13/00; F02M 57/06; F02P 13/00

(52) U.S. Cl. ..... 313/141; 313/118; 313/139; 123/169 EL

(58) Field of Search ..... 313/139, 140, 313/141, 142, 143; 123/169 EL, 169 R, 169 MG, 169 EA; 420/445, 466

(56) References Cited

U.S. PATENT DOCUMENTS

| | | | | |
|---|---|---|---|---|
| 1,163,281 A | | 12/1915 | Sullivan | |
| 1,264,262 A | | 4/1918 | Faber | |
| 1,495,499 A | | 5/1924 | Stanislawski | |
| 2,048,481 A | | 7/1936 | Arnois | |
| 2,299,924 A | | 10/1942 | Ost | |
| 2,487,535 A | | 11/1949 | Fernandez | |
| 2,894,162 A | | 7/1959 | Ignatjev | |
| 3,468,004 A | | 9/1969 | Bretsch | |
| 3,970,885 A | | 7/1976 | Kasima | |
| 4,015,160 A | | 3/1977 | Lara et al. | |
| 4,023,058 A | | 5/1977 | Lara et al. | |
| 4,206,381 A | | 6/1980 | Wax | |
| 4,267,481 A | | 5/1981 | Sauder | |
| 4,268,774 A | | 5/1981 | Forkum, Jr. | |
| 4,484,101 A | | 11/1984 | Ibbott | |
| 4,670,684 A | | 6/1987 | Kagawa et al. | |
| 4,730,582 A | | 3/1988 | Lindsay | |
| 4,914,343 A | | 4/1990 | Kagawa et al. | |
| 4,916,354 A | | 4/1990 | Forkum, Jr. | |
| 4,987,868 A | | 1/1991 | Richardson | |
| 5,204,059 A | * | 4/1993 | Sahira et al. | 123/169 EL X |
| 5,264,754 A | | 11/1993 | Hanitijo et al. | |
| 5,280,214 A | | 1/1994 | Johnson | |
| 5,430,346 A | | 7/1995 | Johnson | |
| 5,982,079 A | * | 11/1999 | Kibbey | 313/141 |

FOREIGN PATENT DOCUMENTS

| | | | | |
|---|---|---|---|---|
| FR | 2612-346 A | | 9/1988 | |
| GB | 187501 | | 10/1922 | |
| GB | A1 167 687 | | 10/1922 | |
| JP | 51-100403 | | 8/1976 | |
| JP | 58034151 A | * | 2/1983 | 313/144 |

* cited by examiner

*Primary Examiner*—Nimeshkumar D. Patel
*Assistant Examiner*—Mack Haynes
(74) *Attorney, Agent, or Firm*—Gifford, Krass, Groh, Sprinkle, Anderson & Citkowski, P.C.

(57) ABSTRACT

A high efficiency spark plug includes a ground electrode having formed of a wire having a circular cross section. The ground electrode has a pair of stanchions and a loop extending over the center electrode of the spark plug. The loop has a center circular portion and a pair of curved portions which form a gap between the two sides of the loop generally equal to the diameter of the wire.

3 Claims, 2 Drawing Sheets

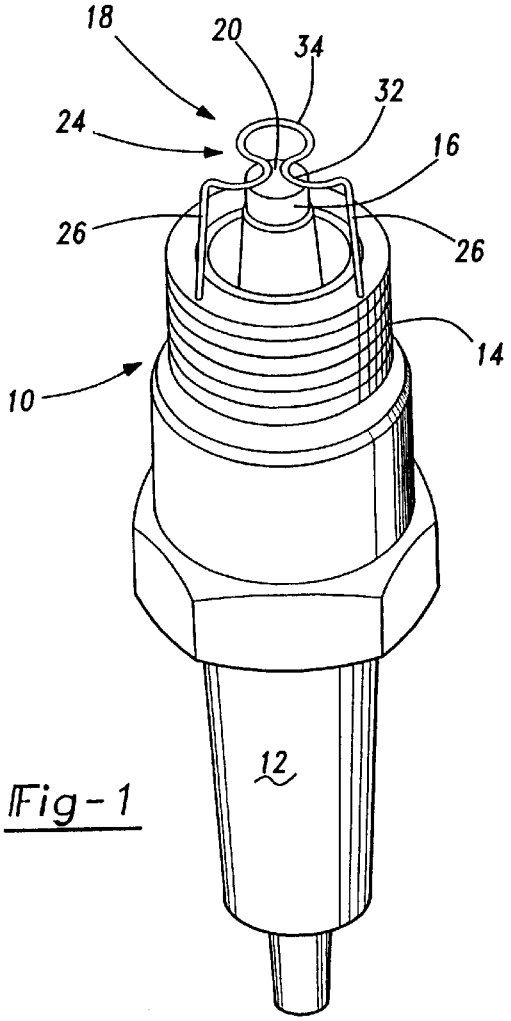
Fig-1
Fig-2
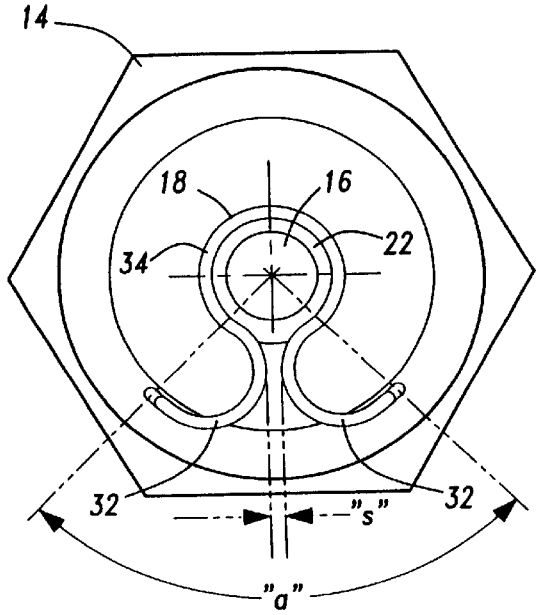
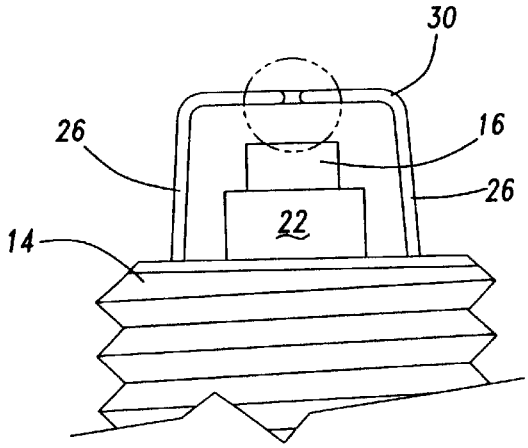
Fig-3
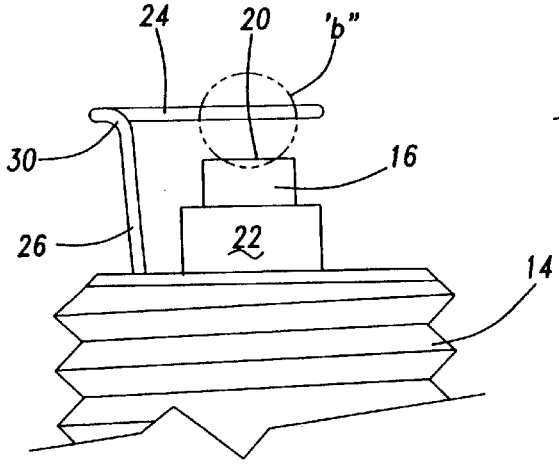
Fig-4

SPARK PLUG

This application is a divisional of application Ser. No. 08/774,233, filed Dec. 27, 1996, now U.S. Pat. No. 5,982, 079, which claims the benefit of U.S. provisional application Ser. No. 60/009,407 filed Dec. 29, 1995, now expired.

BACKGROUND OF THE INVENTION

1. Field of the Invention

This invention relates to an improvement of a spark plug for an internal combustion engine.

2. Prior Art

Spark plugs have long been used in an internal combustion engine to ignite combustible gas within the cylinder. These spark plugs typically include a ground electrode having a flange which is supported in a spaced relationship by a rectangular support from a center electrode. During ignition electrons move between the electrodes to ignite the combustible gasses in the cylinder. A flame front is formed around the spark and moves outwardly from the spark towards the walls of the cylinder. In order to maximize the efficiency of the combustion to maximize the power from the ignition and to minimize emissions, it is desirable to provide the fastest possible speed in the movement of the flame front. It has also been found that efficiency of the burn can be reduced by a shadow in the flame front formed by the rectangular support of the ground electrode. The electrode blocks the flame front as it expands outwardly from the spark and causes a "shadow area" behind the support where the combustible gas is not efficiently or quickly burned. This slows the burning and resulting in a diminution of the power available from the combustion of the fuel. A high efficiency plug, known as the Splitfire plug, which is disclosed in U.S. Pat. No. 5,280,214, has a ground electrode with a "Y" shaped electrode. It has been found that carbon collects in the crotch thereby reducing the efficiency of the plug.

Because of the increased cost of fuel and necessity of minimizing the emissions from internal combustion engines, it is desirable to provide a spark plug which maximizes the efficiency of the burn of the combustible gases.

Accordingly, it is an object of the present invention to provide a spark plug which produces a maximum flame front speed and expansion time.

It is a further object of the present invention to provide a spark plug which reduces or eliminates electrode shadow.

It is still another object of the present invention to provide a spark plug which produces an increase in engine power, fuel efficiency, and minimizes the emissions.

A further object of the invention is to provide a spark plug which is simple in structure and inexpensive to manufacture.

BRIEF SUMMARY OF THE INVENTION

Accordingly it has been found that flame propagation can be maximized by providing a spark plug which produces a spherical flame kernel which is unimpeded by electrode shadow or carbon collection. The spark plug includes a ground electrode which includes a loop supported by a pair of stanchions. The ground electrode has a circular cross section of minimum mass and is contoured to avoid any sharp points. The loop is spaced apart from a center electrode and has a center circular portion extending through an arc of approximately 270°. The loop is connected to the stanchions by support portions which curve together to a position radially outward with respect to the circular portion to define a narrow gap. The gap prevents formation of a carbon collection area. An arch portion curves outwardly and downwardly through an arc approximately 90° to extend between the support portions and the stanchions. The stanchions extend in a direction coaxial with the axis of the spark plug to a metal end of the plug. The stanchions are separated through an arc of approximately 90°. In the preferred embodiment the electrode is formed of a single wire having a minimum diameter as small as possible to maintain the shape. For most suitable metals such as alloys of nickel and cobalt the diameter of the wire is in the range of 0.030 inches plus or minus 0.015 inches.

The ground electrode promotes rapid propagation of the spark kernel and enhanced plasma expansion while presenting a minimum obstruction from the mass of the ground electrode. The circular cross section and contoured shape presents no sharp points and provides for fast heat sink properties. The thin wire stanchions minimize shadow to produce combustion of higher efficiency than other known spark plugs. The spark plug produces substantially increased torque, horse power and fuel economy while reducing carbon dioxide, carbon monoxide, oxides of nitrogen and hydrocarbon emissions.

The aforementioned and other objects and features of the present invention shall be described hereinafter in detail with reference to the preferred embodiments thereof shown in the accompanying drawings in which: BRIEF DESCRIPTION OF THE DRAWINGS FIG. 1 is a perspective view of a spark plug according to the present invention;

FIG. 2 is an end view of the spark plug with ground electrode in accordance with the invention;

FIG. 3 is a partial front view of the ground electrode;

FIG. 4 is a partial side view of the ground electrode with the ground electrode rotated 90° from the view of FIG. 3.

DETAILED DESCRIPTION OF THE PREFERRED EMBODIMENT

Figure 5:
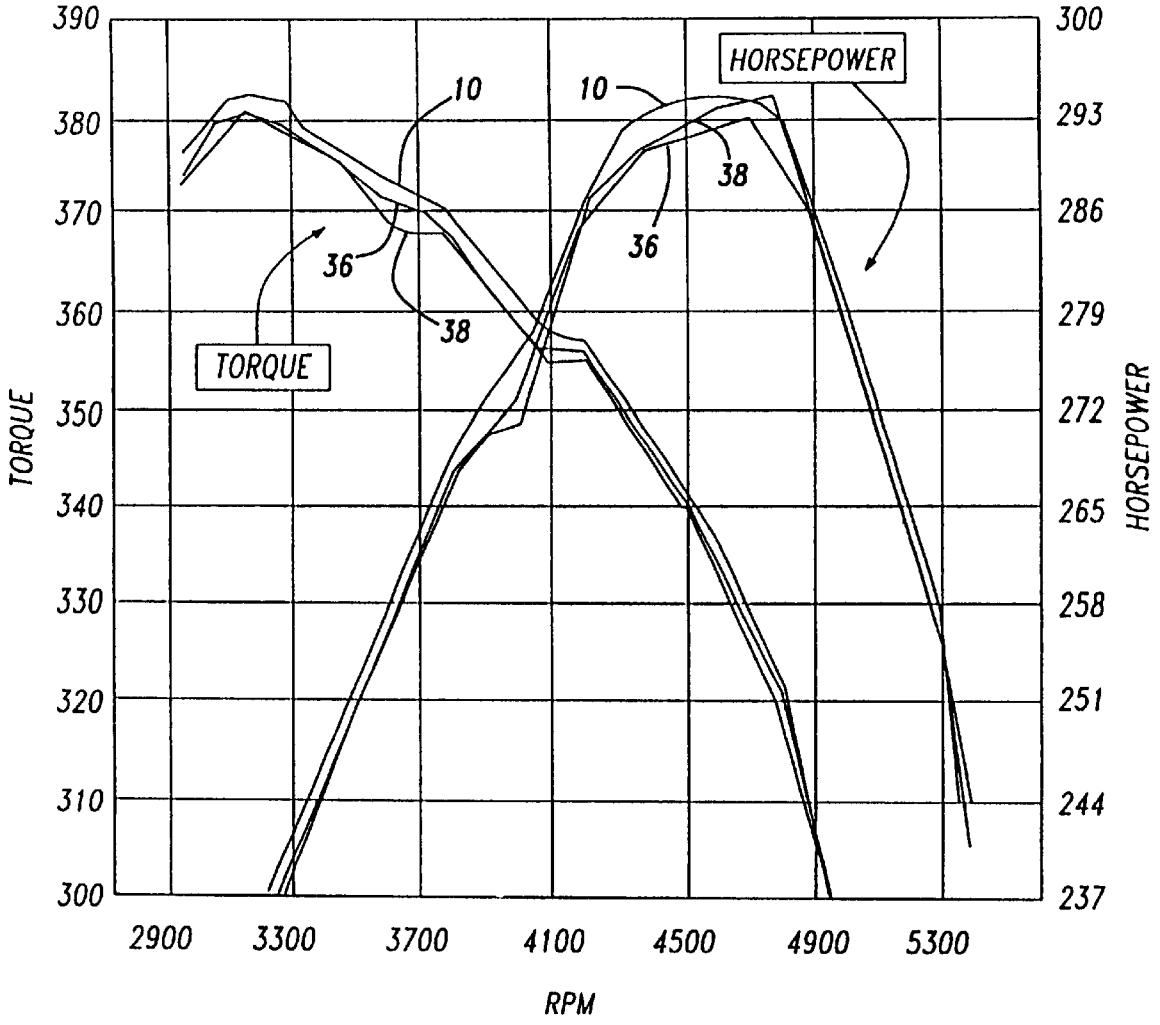
FIG. 5 is a chart comparison of torque and horsepower of the spark plug in accordance with the invention and prior art plugs.

A high efficiency spark plug 10 suitable for use in internal combustion engines is shown in FIG. 1. The spark plug 10 has a conventional threaded cylindrical body 12 and threaded metal end 14. The spark plug 10 further includes a center electrode 16 and a novel ground electrode 18. The center electrode 16 is a metal cylinder with a flat distal end 20. An inner portion is surrounded by a sleeve 22 of a dielectric material such as ceramic to isolate the center electrode 16 from the threaded metal mounting end 14. The center electrode, as shown in FIGS. 1 and 2, has a diameter in the range of between 0.025 and 0.125 inches, preferably 0.100 inch.

As best shown in FIG. 2, the ground electrode 18 includes a loop portion 24 supported in a spaced concentric relationship from the center electrode 16 by a pair of stanchions 26. The stanchions 26 extend from the threaded end 14 in a direction coaxial to the axis of the spark plug 10. The stanchions 26 are separated though an arc "a" in the range of 45° to 135° and preferably 90°. As shown in FIGS. 3 and 4, at the outer end of each stanchion 26 is an arc portion 30 which curves 90° towards the other stanchion, and has a radius ranging between 0.025 inches and 0.075 inches and in the preferred embodiment of 0.050 inches.

As best shown in FIG. 2, the loop portion 24 includes a pair of semicircular support portions 32 extending between a partial circular portion 34 and the stanchions 26. The support portions 32 curve radially outwardly from the partial circular portion 34 toward each other to form a space "S" and then continue to curve to the respective stanchions 26. The support portions 32 have a radius in the range from 0.025 to 0.075 inches and preferably 0.050 inches. The space "S" between the support portions 32 is approximately equal to the diameter of the ground electrode 18. The space prevents formation of a collection area for carbon. The partial circular portion 34 and the support portions 32 extend along a plane which extends in a radial direction with respect to an axis of the spark plug 10 and the circular portion 34 extends through an arc of between 225° and 315° and in the preferred embodiment is approximately 270° before curving outwardly to form the support portions 32. The diameter of the circular portion 34 is in the range from 0.7 to 1.3 times the diameter of the center electrode 16 and in the preferred embodiment equal to or slightly greater than the diameter of the center electrode or approximately 0.100 inches.

The ground electrode 18 is preferably formed of continuous wire having a diameter in the range from 0.015 inches to 0.45 inches and preferably 0.0325 inches. The diameter of the wire is dependent upon the metal which the wire is made from. The diameter is chosen to be the smallest possible permissible to permit to wire to hold the shape. It has been found that the smaller the diameter of the wire, the less hindrance of the propagation of the flame front during combustion. The ground electrode is formed of an alloy of nickel, cobalt. In the preferred embodiment Haynes Wire Heat No. 1880-3-1631 containing nickel and 30–40% cobalt is used. The stanchions have a length to support the loop portion 24 a distance of typically approximately 0.010 to 0.125 from the end 20 of the center electrode 16. This distance is determined in the same manner as a conventional plug, but the distance between the loop and center electrode for the improved spark plug 10 is typically slightly less than in a conventional plug.

The spark plug in accordance with the invention produces a long duration, high intensity ignition with a spherical bubble "b" of hot ionized gas with a plasma layer on the outside encompassing the entire loop of the anode and electrode and the end of the electrode.

The spark plug according to the invention utilizing this alloy and having the preferred dimensions above is shown to provide greatly improved fuel usage and overall performance improvement, that is, horsepower, torque and combustion efficiency. As shown in Table 1 and FIG. 5, the torque and horsepower of the spark plug 10 (identified as "IM" in Table 1) according to the invention was compared with two high efficient prior art plugs, the AC RapidFire 36 and the SplitFire 38 spark plugs.

TABLE 1

| | IM | | SPLITFIRE | | RAPIDFIRE | |
|---|---|---|---|---|---|---|
| RPM | C TORQ | C PWR | C TORQ | C PWR | C TORQ | C PWR |
| 3000 | 375.9 | 214.7 | 373.1 | 213.3 | 373.6 | 213.8 |
| 3100 | 380.6 | 224.7 | 377.4 | 222.7 | 379.3 | 223.9 |
| 3200 | 382.3 | 232.9 | 380.7 | 232.0 | 380.5 | 231.9 |
| 3300 | 381.5 | 239.7 | 379.1 | 238.1 | 379.6 | 238.6 |
| 3400 | 378.6 | 245.2 | 377.7 | 244.5 | 376.9 | 244.0 |
| 3500 | 376.6 | 251.0 | 374.3 | 249.4 | 374.5 | 249.7 |
| 3600 | 374.0 | 256.3 | 370.3 | 253.8 | 371.6 | 254.7 |
| 3700 | 372.7 | 262.6 | 368.3 | 259.5 | 370.4 | 260.9 |
| 3800 | 370.5 | 268.1 | 368.0 | 266.3 | 368.1 | 266.3 |

TABLE 1-continued

| | IM | | SPLITFIRE | | RAPIDFIRE | |
|---|---|---|---|---|---|---|
| RPM | C TORQ | C PWR | C TORQ | C PWR | C TORQ | C PWR |
| 3900 | 366.4 | 272.0 | 362.9 | 269.5 | 363.9 | 270.2 |
| 4000 | 361.6 | 350.0 | 358.6 | 271.0 | 357.9 | 272.6 |
| 4100 | 358.1 | 279.5 | 355.3 | 277.4 | 356.1 | 278.0 |
| 4200 | 357.1 | 285.5 | 355.2 | 284.2 | 355.8 | 284.6 |
| 4300 | 353.8 | 289.7 | 350.7 | 287.2 | 352.5 | 288.6 |
| 4400 | 349.2 | 292.4 | 347.2 | 290.8 | 346.8 | 290.4 |
| 4500 | 343.4 | 294.1 | 340.9 | 292.2 | 340.0 | 291.3 |
| 4600 | 336.2 | 294.4 | 335.1 | 293.4 | 333.2 | 291.9 |
| 4700 | 328.6 | 294.0 | 328.3 | 293.8 | 327.1 | 292.7 |
| 4800 | 321.5 | 293.8 | 322.5 | 294.7 | 318.4 | 291.0 |
| 4900 | 309.6 | 288.8 | 309.3 | 288.5 | 309.0 | 288.2 |
| 5000 | 294.2 | 280.1 | 295.4 | 281.2 | 295.6 | 281.4 |
| 5100 | 281.1 | 272.9 | 280.8 | 272.7 | 280.7 | 272.6 |
| 5200 | 267.1 | 264.5 | 266.2 | 263.4 | 266.4 | 263.8 |

A modern computer control V-8 engine was utilized and the data was collected and stored in a computer incorporated as part of a dynamometer. The torque, power, oil temperature and other variables were collected for each spark plug at approximately 100 rpm intervals from 3,000 to 5,400 rpm. As shown in FIG. 5, it seen that the spark plug 10 of the invention produced greater torque and power than the prior art plugs.

Although the present invention has been described with reference to preferred embodiments thereof, many modifications and alterations may be made within the spirit of the present invention.

I claim:

1. A spark plug for an internal combustion engine comprising:

an elongate body having a center electrode; and a ground electrode spaced apart from said center electrode, said ground electrode formed of a metal alloy of nickel and cobalt, said cobalt being in the range of 30–40%.

2. A spark plug for an internal combustion engine comprising:

an elongated body having a center electrode; and a ground electrode having a circular cross-section having a diameter of less than 0.50 inches, said ground electrode having a pair of stanchions and a pair of connecting portions supporting a loop in a spaced apart relationship from said center electrode, said loop having a predetermined diameter, each of said pair of connecting portions extending between one end of said loop and one of said stanchions to form a predetermined space therebetween, said space being less than said diameter of said loop.

3. A spark plug for an internal combustion engine comprising:

an elongate body having a center electrode; and a ground electrode spaced apart from said center electrode, said ground electrode formed of a metal alloy of nickel and cobalt, said ground wire being formed of a continuous wire having a diameter of 0.015 to 0.45 inches.

* * * * *

UNITED STATES PATENT AND TRADEMARK OFFICE

CERTIFICATE OF CORRECTION

PATENT NO. : 6,344,707 B1
DATED : February 5, 2002
INVENTOR(S) : Wilbur R. Kibbey It is certified that error appears in the above-identified patent and that said Letters Patent is hereby corrected as shown below:

Column 4,
Line 26, after "it" insert -- can --.
Line 27, delete "power" and insert -- horsepower --.

Signed and Sealed this

Eleventh Day of February, 2003

JAMES E. ROGAN
*Director of the United States Patent and Trademark Office*